US009289987B2

(12) United States Patent
Cook et al.

(10) Patent No.: US 9,289,987 B2
(45) **Date of Patent: *Mar. 22, 2016**

(54) HEATING ELEMENT FOR A PRINTHEAD

(71) Applicant: Hewlett-Packard Development Company, L.P., Houston, TX (US)

(72) Inventors: Galen P. Cook, Albany, OR (US); Bradley D. Chung, Corvallis, OR (US); Anthony M. Fuller, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/397,720

(22) PCT Filed: Oct. 31, 2012

(86) PCT No.: PCT/US2012/062700

§ 371 (c)(1),
(2) Date: Oct. 29, 2014

(87) PCT Pub. No.: WO2014/130002

PCT Pub. Date: Aug. 28, 2014

(65) Prior Publication Data

US 2015/0266293 A1 Sep. 24, 2015

(51) Int. Cl.
*B41J 2/05* (2006.01)
*B41J 2/14* (2006.01)
(Continued)

(52) U.S. Cl.
CPC ..... *B41J 2/14129* (2013.01); *B41J 2/1601* (2013.01); *B41J 2/1603* (2013.01); *B41J 2/164* (2013.01); *B41J 2/1626* (2013.01);
(Continued)

(58) Field of Classification Search
None
See application file for complete search history.

(56) References Cited

U.S. PATENT DOCUMENTS

| | | | |
|---|---|---|---|
| 5,424,246 | A | 6/1995 | Matsuo et al. |
| 6,398,348 | B1 | 6/2002 | Haluzak et al. |
| 7,731,337 | B2 | 6/2010 | Kang et al. |
| 7,940,157 | B2 | 5/2011 | Chen et al. |

(Continued)

FOREIGN PATENT DOCUMENTS

| | | |
|---|---|---|
| DE | 10128433 | 10/2002 |
| WO | WO2005118298 | 12/2005 |
| WO | WO2009015353 | 1/2009 |

OTHER PUBLICATIONS

Korean International Search Report and Written Opinion, dated Aug. 26, 2014, for PCT/US2012/062700, filed Oct. 31, 2012, 12 pages.
Tanaka, A. et al, Quasi-2-dimensional Compact Resistor Model for the Drift Region in High-voltage LDMOS Devices, (Research paper), IEEE Transactions on Electron Devices, Jul. 2011, pp. 2072-2080, vol. 58, No. 7.

*Primary Examiner* — Erica Lin
(74) *Attorney, Agent, or Firm* — International IP Law Group, PLLC

(57) ABSTRACT

An exemplary embodiment of the present invention provides for a fluid ejection device. The fluid ejection device includes a substrate, a conductive layer, a resistive layer, and at least one upper layer. The conductive layer is disposed on the substrate and an outer perimeter and an inner region thinner than the outer perimeter. The outer perimeter includes conductive elements spaced apart from one another. The resistive layer includes an outer resistive portion overlying the conductive elements and a central resistive portion lying on top of a raised bridge of the substrate, wherein the width of the raised bridge is substantially greater than the width of the central resistive portion. The at least one upper layer defines a boundary of a fluid chamber, and the boundary is aligned vertically above a border of the central resistive portion.

15 Claims, 12 Drawing Sheets

1000

(51) Int. Cl.
*B41J 2/16* (2006.01)
*F22B 1/28* (2006.01)

(52) U.S. Cl.
CPC ..... *B41J 2/1646* (2013.01); *F22B 1/284* (2013.01); *Y10T 29/49083* (2015.01); *Y10T 29/49401* (2015.01)

(56) References Cited

U.S. PATENT DOCUMENTS

| | | | | |
|---|---|---|---|---|
| 2001/0008411 | A1 | 7/2001 | Maze et al. | |
| 2002/0075346 | A1 | 6/2002 | Xu et al. | |
| 2009/0025634 | A1 * | 1/2009 | Chung et al. ..... | 118/59 |

* cited by examiner

100

112

300

300

500

500

700

700

800

800

900

900

1000

1000

1100

1200

HEATING ELEMENT FOR A PRINTHEAD

CROSS-REFERENCE TO RELATED APPLICATION

Pursuant to 35 U.S.C. §371, this application is a United States National Stage Application of International Patent Application No. PCT/US2012/062700, filed on Oct. 31, 2012, the contents of which are incorporated by reference as if set forth in their entirety herein.

BACKGROUND

Conventional ink cartridges include a printhead integrated within the cartridge or alternatively comprise an ink supply separate from a printhead. In some instances, a printhead integrated within an ink cartridge fails prior to the ink supply being exhausted, forcing the consumer to replace the partially used ink cartridge. In other situations, commercial printers using industrial-type printheads may have to shut down their production when a printhead fails. This shutdown causes lost income from suspended production as well as increased maintenance cost for professional replacement of the failed printhead. In either case, a significant disruption occurs.

One type of printhead is a thermal fluid ejection device. In a thermal fluid ejection device, ink fluid is contained within a chamber overlying a resistor. By sending electricity through connected conductor elements, the resistor can be heated, which in turn causes the ink fluid immediately above the resistor to vaporize and expand. The ink above the growing vapor bubble is forced to exit the chamber through an orifice, which becomes an ejected drop of ink. The functionality of the thermal fluid ejection device is dependent on the resistor. If the resistor fails, then the thermal fluid ejection device ceases to operate correctly.

BRIEF DESCRIPTION OF THE DRAWINGS

Certain exemplary embodiments are described in the following detailed description and in reference to the drawings, in which.

DETAILED DESCRIPTION OF SPECIFIC EMBODIMENTS

The present disclosure relates to a heating element of a fluid ejection device and techniques of forming the same. One source of printhead failure is topography on a heating element of the printhead. Topography refers to the variances in the heights of features on the surface of the heating element. Ideally, the surface of the heating element should be flat, so as to reduce the amount of stress placed on the layers of material overlying the resistor. However, present day methods for forming heating elements often involve depositing and etching various layers of conductive, resistive, and insulating material, thus creating topography. The present techniques reduce the topography of a resistor on a heating element by creating a nearly two-dimensional resistor structure. By minimizing the local topography around the heating element, resistor life can be improved.

In embodiments, the heating element of the fluid ejection device is disposed in an inkjet printhead. In an embodiment, a resistor pad is formed on a raised bridge on a heating element. The width of the resistor pad is smaller than the width of the raised bridge, resulting in substantially lower profile topography. This low profile topography of the central resistor pad, in turn, promotes a more homogeneous formation of the respective upper layers (e.g., passivation and cavitation barrier) to exhibit greater strength and integrity for resisting penetration by corrosive inks, thereby increasing the longevity of the central resistor pad and the printhead. In embodiments, the method of forming the heating region includes forming the conductive elements (surrounding the end portions of the central resistor pad) of the heating region so that relatively steeper or thicker portions of the conductive elements are located externally of the sidewall of a fluid chamber of the heating region. This arrangement facilitates positioning the low profile topography of central resistor pad, and therefore the low profile topography of the upper layers, within the fluid chamber.

Figure 1:
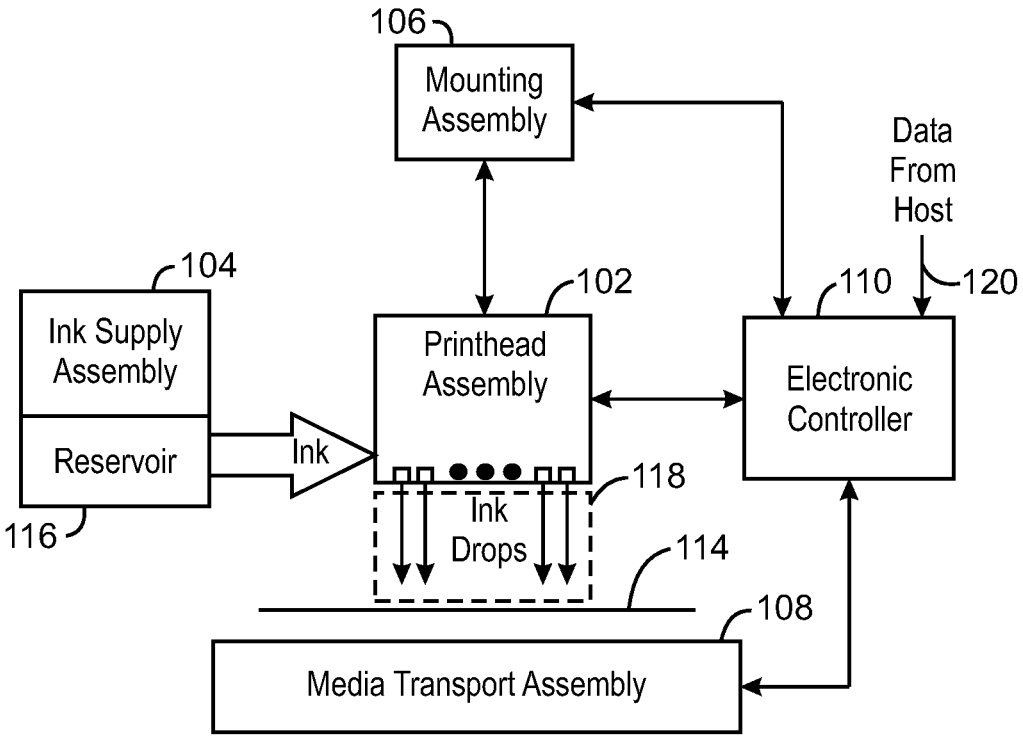
FIG. 1 is a block diagram of an inkjet printing system.

FIG. 1 is a block diagram of an inkjet printing system. The inkjet printing system 100 comprises one embodiment of a fluid ejection system which includes a fluid ejection assembly, such as an inkjet printhead assembly 102, and a fluid supply assembly, such as an ink supply assembly 104. In the illustrated embodiment, the inkjet printing system 100 also includes a mounting assembly 106, a media transport assembly 108, and an electronic controller 110. The inkjet printhead assembly 102 includes one or more printheads or fluid ejection devices which eject drops of ink or fluid through a plurality of fluid ejection devices 112. In embodiments, the drops are directed toward a medium, such as print medium 114, so as to print onto the print medium 114. The print medium 114 can be any type of suitable sheet material, such as paper, card stock, transparencies, Mylar, and the like. Typically, the fluid ejection devices 112 are arranged in one or more columns or arrays such that properly sequenced ejection of ink from fluid ejection devices 112 causes characters, symbols, or other graphics or images to be printed upon the print medium 114 as the inkjet printhead assembly 102 and the print medium 114 are moved relative to each other.

The ink supply assembly 104 supplies ink to the printhead assembly 102 and includes a reservoir 116 for storing ink. Ink flows from reservoir 116 to the inkjet printhead assembly 102.

In embodiments, the inkjet printhead assembly 102 and the ink supply assembly 104 are housed together in an inkjet or fluidjet cartridge or pen. In embodiments, the ink supply assembly 104 is separate from the inkjet printhead assembly 102 and supplies ink to the inkjet printhead assembly 102 through an interface connection, such as a supply tube (not shown). In either embodiment, the reservoir 116 of the ink supply assembly 104 may be removed, replaced, or refilled.

The mounting assembly 106 positions the inkjet printhead assembly 102 relative to the media transport assembly 108, and the media transport assembly 108 positions the print medium 114 relative to the inkjet printhead assembly 102. Thus, a print zone 118 is defined adjacent to the fluid ejection devices 112 in an area between the inkjet printhead assembly 102 and the print medium 114.

The electronic controller 110 communicates with the inkjet printhead assembly 102, the mounting assembly 106, and the media transport assembly 108. The electronic controller 110 receives data 120 from a host system, such as a computer, and includes memory for temporarily storing the data 120. Typically, the data 120 is sent to the inkjet printing system 100 along an electronic, infrared, optical or other information transfer path. The data 120 may represent, for example, a document and/or file to be printed. As such, the data 120 forms a print job for the inkjet printing system 100 and includes one or more print job commands and/or command parameters.

In embodiments, the electronic controller 110 provides control of the inkjet printhead assembly 102 including timing control for ejection of ink drops from the fluid ejection devices 112. As such, the electronic controller 110 defines a pattern of ejected ink drops which form characters, symbols, and/or other graphics or images on the print medium 114. Timing control and, therefore, the pattern of ejected ink drops, is determined by the print job commands and/or command parameters. In embodiments, logic and drive circuitry forming a portion of the electronic controller 110 is located on the inkjet printhead assembly 102. In another embodiment, logic and drive circuitry is located off the inkjet printhead assembly 102.

Each fluid ejection device 112 utilizes a resistor to discharge ink. The resistor may be protected by a number of barrier layers in each fluid ejection device 112 (e.g., passivation and cavitation barrier layers). As the barrier layers may take on the topographic profile of the resistor, it is beneficial to reduce the topography of the resistor so as to minimize the possibilities of failure in the areas of the barrier layers near the resistor. In embodiments described herein, a low-topography heating element of a fluid ejection device is formed to reduce the risk of failure in the barrier layers and improve the life of the resistor.

Figure 2:
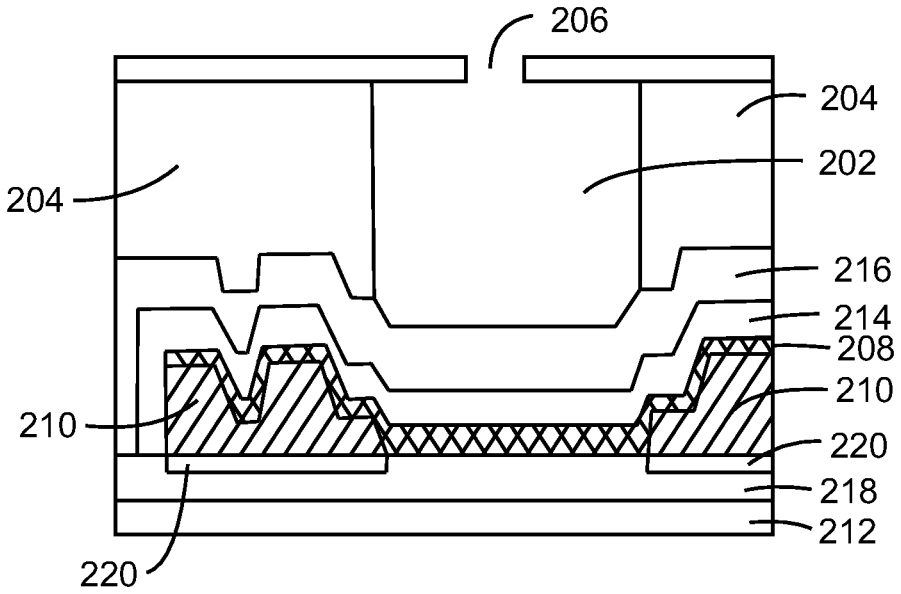
FIG. 2 is a cross-section diagram of a fluid ejection device.

FIG. 2 is a cross-section of a fluid ejection device. The fluid ejection device 112 may be included in the printhead of an inkjet printing system, as shown in FIG. 1, for example. The fluid ejection device 112 can store ink in a fluid chamber 202 whose boundaries are defined by a set of barrier layers 204 (e.g., SU8). During the printing process, the fluid ink layer above the resistor can be heated and vaporized, thus forcing the fluid ink above the growing vapor bubble through an orifice 206. In embodiments, the ink is heated by a resistor layer 208 near the bottom of the fluid ejection device. The resistor layer 208 may overlie a set of conductive elements 210 and a substrate 212. In embodiments, the resistor layer 208 is protected by a passivation layer 214 and a cavitation barrier layer 216, both of which reside underneath the barrier layers 204. The portion of the resistor layer 208 that is directly underneath the fluid chamber 202 is defined as a resistor pad.

In embodiments, the resistor layer 208 may be composed of, but not limited to, tungsten silicon nitride, tantalum aluminum, nickel chromium, or titanium nitride.

The conductive elements 210, which may be contained underneath the resistor layer outside the boundaries of the fluid chamber 202, serve to accept an electrical charge that is used to heat the resistor pad of the resistor layer 208. The conductive elements 210 may be composed of, but not limited to, aluminum, gold, tantalum, tantalum-aluminum, or any other metal or metal alloy.

The passivation layer 214 and the cavitation barrier layer 216 overlie the resistor layer 208 to protect the resistor layer 208. The passivation layer 214 may protect the underlying resistor pad and the resistive-covered conductive elements 210 from the corrosive properties of the ink contained within the fluid chamber 202. The cavitation barrier layer 216, which may overlie the passivation layer 214, may act to cushion the underlying resistive-covered structures from the force generated by bubble formation upon heating of the resistor pad. It is to be noted that the shape of the passivation layer 214 and the cavitation barrier layer 216 is molded to reflect the topographic profile of the resistive layer 208. High-profile topographic features in the passivation layers 214 and the cavitation barrier layer 216 may reduce the effectiveness of the protection that the layers provide for the resistor layer 208. The passivation layer 214 may be composed of, but not limited to, aluminum oxide, silicon carbide, silicon nitride, glass, or a silicon nitride/silicon carbide composite. The cavitation barrier layer 216 may be composed of, but not limited to, a tantalum material or a polymer material such as photoimpregnable epoxy or other photoimpregnable polymers.

The substrate 212, which supports the resistor layer 208 and the conductive elements 210, may also include an insulation layer 218 and one or more neutralizing layers 220. The insulation layer 218 may provide a fluid barrier as well as electrical and thermal protection for the substrate 212. The neutralizing layers 220 may underlie the conductive elements 210. The substrate 212 may be composed of a silicon wafer, a glass material, a semiconductor material, or any other known material suitable for use as a substrate for a fluid ejection device. The insulation layer 218 may be composed of silicon dioxide, aluminum oxide, silicon carbide, silicon nitride, or glass. The neutralizing layer 220 may be composed of titanium nitride in embodiments. The neutralizing layer 220 may also contain titanium tungsten, titanium, titanium allow, metal nitride, tantalum aluminum, or aluminum silicone.

FIGS. 3-9 illustrate a method of making a heating region of a fluid ejection device, according to embodiments of the invention. In embodiments, the heating region of the fluid ejection device comprises substantially the same features and attributes as the fluid ejection device or printhead assembly described and illustrated in FIGS. 1-2.

Figure 3A:
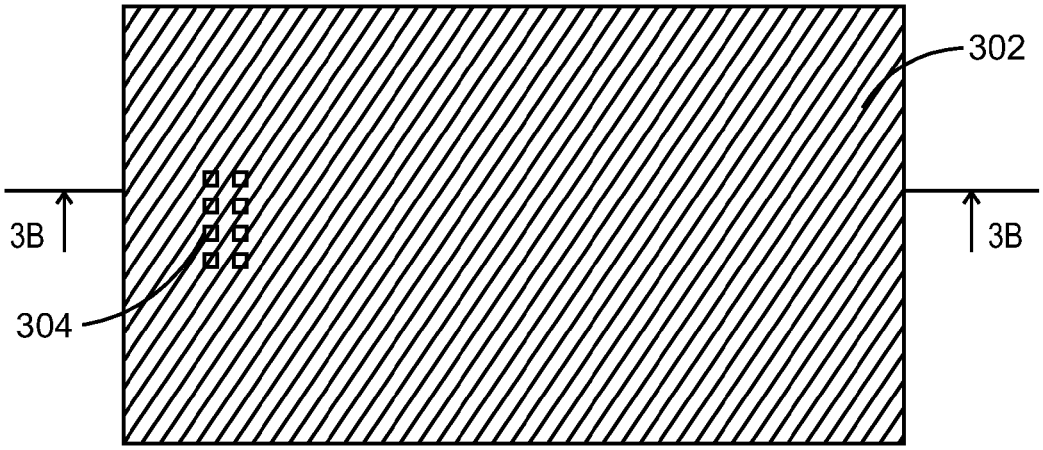
FIGS. 3A and 3B are a top view and a cross-section front view of a partially formed heating element of a fluid ejection device.
Figure 3B:
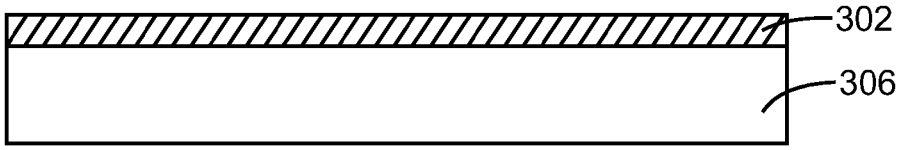

FIGS. 3A and 3B are a top view and a cross-section front view of a partially formed heating element of a fluid ejection device. FIG. 3A is a top view illustrating the partially formed heating element 300. As seen in FIG. 3A, the partially formed heating element can include a first conductive layer 302 and an array of via pads 304. The via pads 304 provide a conductive path through the substrate to conductive traces that are used to deliver current to the heating pad. The conductive layer 302 can be deposited over the entirety of the heating element using known techniques including, but not limited to, sputtering and evaporation. As discussed above, the material of the first conductive layer 302 may be aluminum, gold, tantalum, tantalum-aluminum, or any other metal or metal alloy.

FIG. 3B is a cross-section front view illustrating the partially formed heating element 300. As seen in FIG. 3B, the first conductive layer 302 has been deposited over a substrate 306. In embodiments, the first conductive layer 302 has a thickness of approximately 3000 Angstroms. In embodiments, the substrate 306 also includes an insulation layer as well as a neutralizing layer underlying the first conductive layer 302. In embodiments, the insulation layer may be an oxide material, and the neutralizing layer may be a titanium nitride material.

Figure 4A:
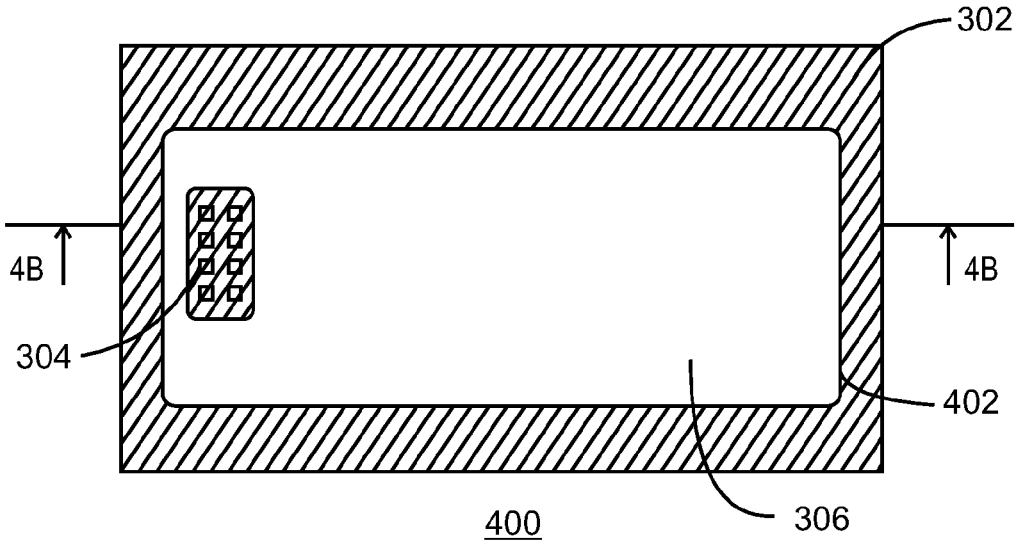
FIGS. 4A and 4B are a top view and a cross-section front view of a partially formed heating element of a fluid ejection device.
Figure 4B:
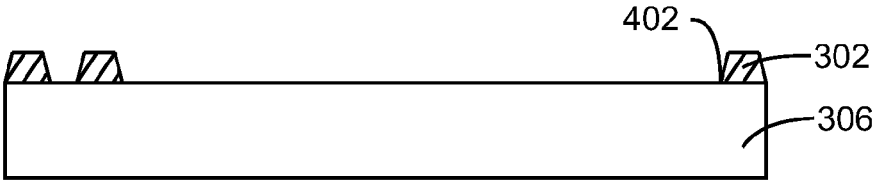

FIGS. 4A and 4B are a top view and a cross-section front view of a partially formed heating element of a fluid ejection device. FIG. 4A is a top view illustrating the partially formed heating element 400. As seen in FIG. 4A, a first window 402 has been etched into the partially formed heating element 300 of FIG. 3A, removing a portion of the first conductive layer 302 and exposing the substrate 306. Portions of the first conductive layer 302 along the edges of the partially formed heating element 400 and overlying the array of via pads 304 may be preserved.

FIG. 4B is a cross-section front view illustrating the partially formed heating element 400. As seen in FIG. 4B, the partially formed heating element 400 has been etched such that much of the material of the first conductive layer 302 has been removed. The depth of the etch may be similar to the thickness of the first conductive layer 302, which, in embodiments, may be approximately 3000 Angstroms.

Figure 5A:
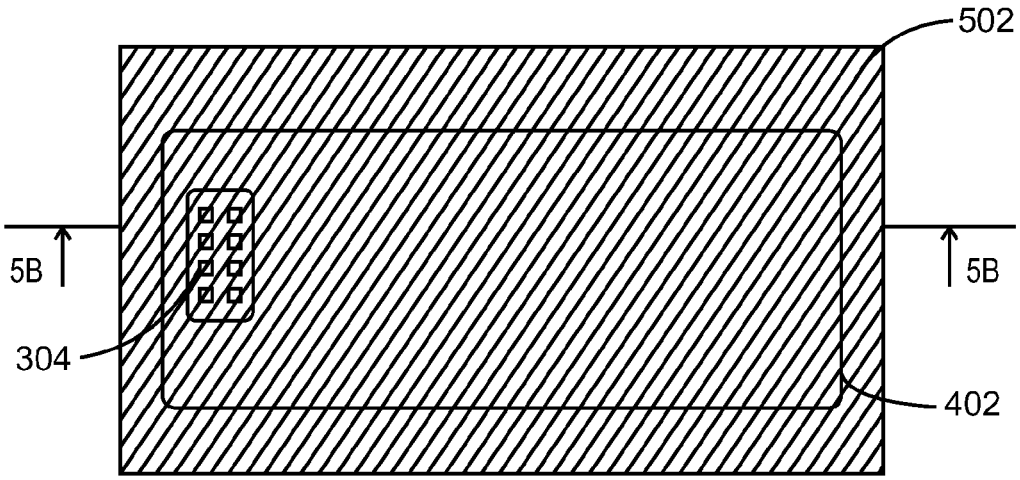
FIGS. 5A and 5B are a top view and a cross-section front view of a partially formed heating element of a fluid ejection device.
Figure 5B:
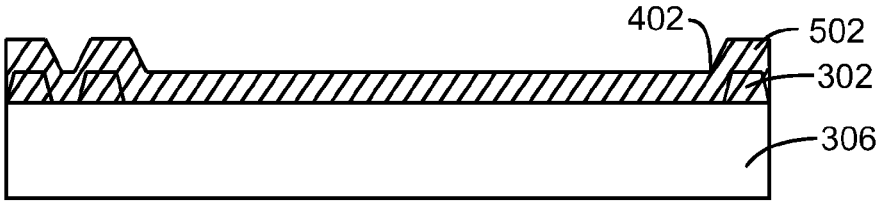

FIGS. 5A and 5B are a top view and a cross-section front view of a partially formed heating element of a fluid ejection device. FIG. 5A is a top view illustrating the partially formed heating element 500. As seen in FIG. 5A, a second conductive layer 502 has been deposited over the partially formed heating element 400 of FIG. 4B. The second conductive layer 502 may be composed of the same material as the first conductive layer 302. It is to be noted that the substrate 306 is no longer exposed at this stage.

FIG. 5B is a cross-section front view illustrating the partially formed heating element 500. As seen in FIG. 5B, the second conductive layer 502 is deposited over the entirety of the partially formed heating element 500. In embodiments, the thickness of the second conductive layer 502 may be approximately 2000 Angstroms. It is to be noted that the thickness of the conductive material near the edges of the partially formed heating element 500 and overlying the array of via pads 304 is substantially greater than the thickness of the conductive material contained within the first window 402.

Figure 6A:
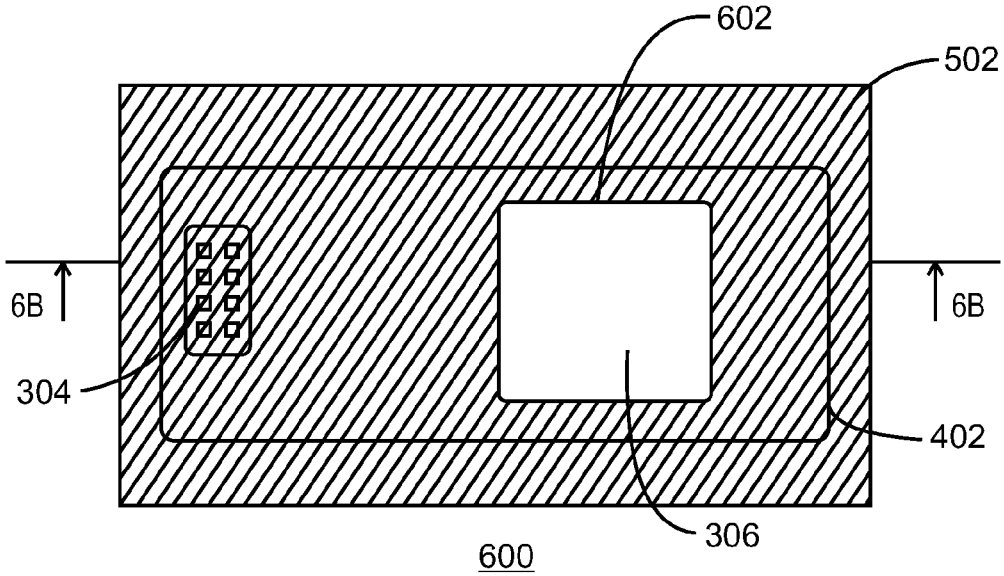
FIGS. 6A and 6B are a top view and a cross-section front view of a partially formed heating element of a fluid ejection device.
Figure 6B:
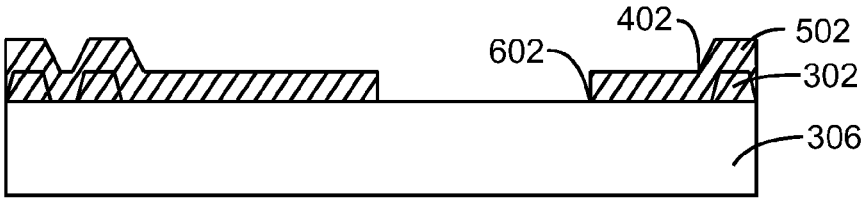

FIGS. 6A and 6B are a top view and a cross-section front view of a partially formed heating element of a fluid ejection device. FIG. 6A is a top view illustrating the partially formed heating element 600. As seen in FIG. 6A, a second window 602 has been etched into the partially formed heating element 500 of FIG. 5A, removing a portion of the second conductive layer 502 and re-exposing the substrate 306. The second window 602 may be contained inside the first window 402.

FIG. 6B is a cross-section front view illustrating the partially formed heating element 600. As seen in FIG. 6B, the partially formed heating element 600 has been etched such that some of the material of the second conductive layer 502 has been removed. The depth of the etch may be similar to the thickness of the second conductive layer 502, which, in embodiments, may be approximately 2000 Angstroms.

Figure 7A:
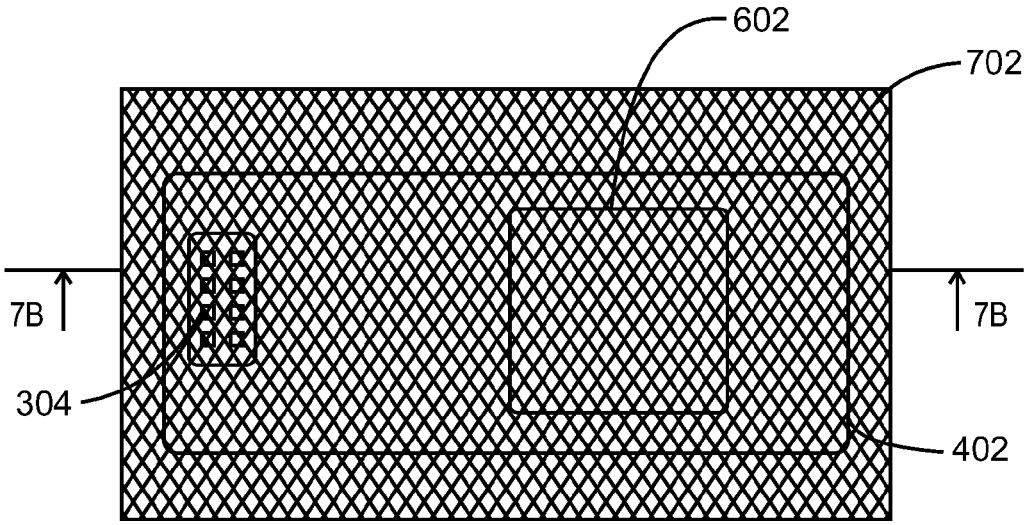
FIGS. 7A and 7B are a top view and a cross-section front view of a partially formed heating element of a fluid ejection device.
Figure 7B:
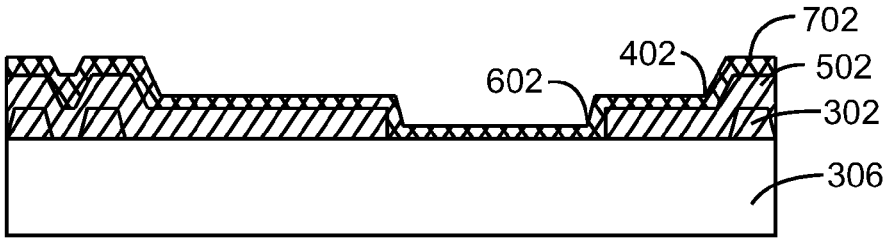

FIGS. 7A and 7B are a top view and a cross-section front view of a partially formed heating element of a fluid ejection device. FIG. 7A is a top view illustrating the partially formed heating element 700. As seen in FIG. 7A, a resistive layer 702 has been deposited over the partially formed heating element 600 of FIG. 6B. In embodiments, the resistive layer 702 is substantially thinner than either the first conductive layer 302 or the second conductive layer 302. It is to be noted that the substrate 306 is no longer exposed at this stage.

FIG. 7B is a cross-section front view illustrating the partially formed heating element 700. As seen in FIG. 7B, the resistive layer 702 has been deposited over the entirety of the partially formed heating element 700. In embodiments, the thickness of the resistive layer 702 may be approximately 1000 Angstroms.

Figure 8A:
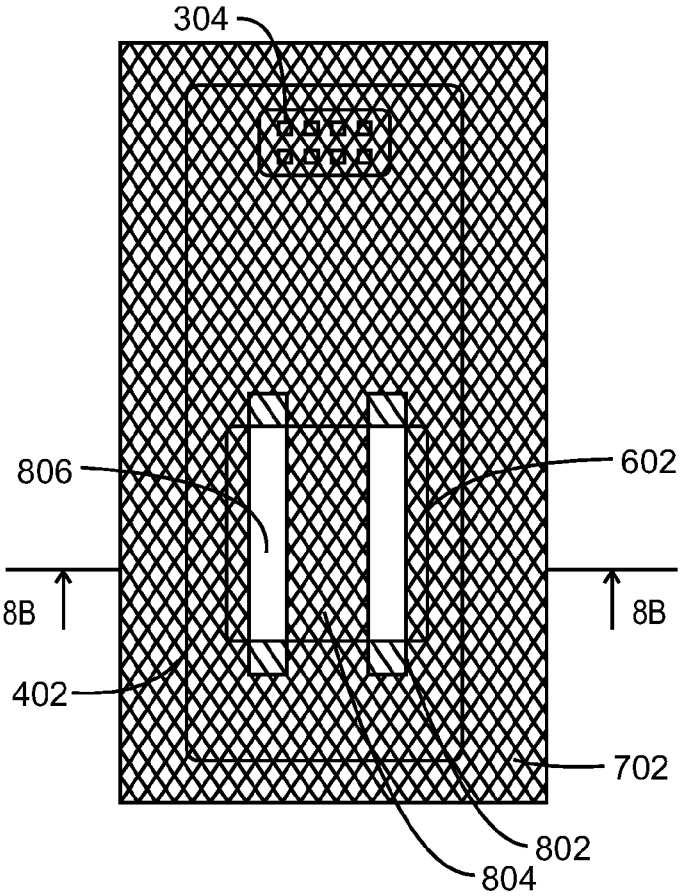
FIGS. 8A and 8B are a top view and a cross-section side view of a partially formed heating element of a fluid ejection device.
Figure 8B:
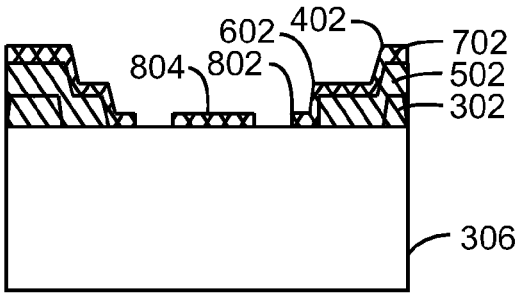

FIGS. 8A and 8B are a top view and a cross-section side view of a partially formed heating element of a fluid ejection device. FIG. 8A is a top view illustrating the partially formed heating element 800. As seen in FIG. 8A, a pair of slots 802 has been etched into the partially formed heating element 700 of FIG. 7A, removing portions of the resistive layer 700 and re-exposing the substrate 306. The slots 802 may be etched over the second window 602. The ends of the slots 802 may extend past the lateral boundaries of the second window 602. A central resistive portion outlined by the lateral boundaries of the second window 602 and the slots 802 may be used to define a resistor pad 804.

FIG. 8B is a cross-section side view illustrating the partially formed heating element 800. As can be seen in FIG. 8B, portions of the resistive layer 702 inside the second window 602 have been removed. The depth of the etch may be substantially equal to the thickness of the resistive layer 702. It is to be noted that the topographic profile of the defined resistor pad 804 is low relative to other topographical features on the partially formed heating element 800.

Figure 9A:
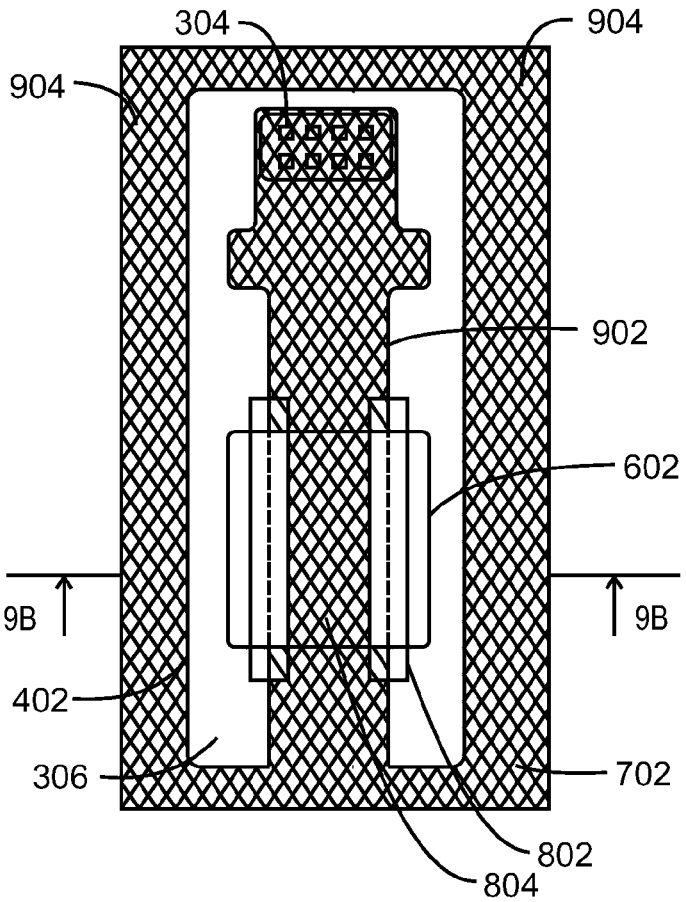
FIGS. 9A and 9B are a top view and a cross-section side view of a heating element of a fluid ejection device.
Figure 9B:
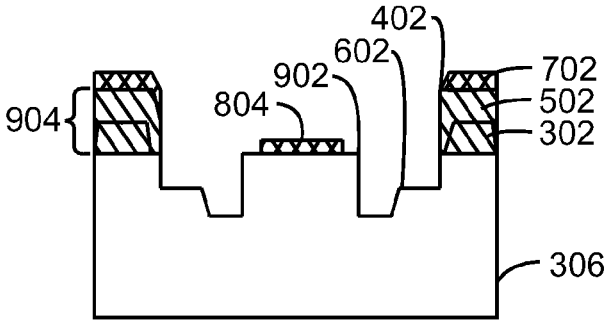

FIGS. 9A and 9B are a top view and a cross-section side view of a heating element of a fluid ejection device. FIG. 9A is a top view illustrating the heating element 900. As seen in FIG. 8A, the partially formed heating element 800 of FIG. 8B has been etched so as to re-expose the substrate 306. The deep etch 902 may define the conduction path from vias 304, through the defined resistor pad 804, and ultimately to electrically grounded conductor material remaining on the other side of the resistor. Remaining conductive elements 904 may be beveled inwards. Enough of the resistive layer 702 may be preserved such that the array of via pads 304 and the conductive elements 904 are covered with resistive material and connected to the resistor pad 804.

FIG. 9B is a cross-section side view illustrating the heating element 900. As seen in FIG. 9B, the heating element has experienced deep etch 902 so as to define the conductive elements 904 as well as a raised bridge that the resistor pad 804 lies on. The topographic profile of the partially formed heating element 800 of FIG. 8B may be maintained in the heating element 900 of FIG. 9B. The depth of the etch may be similar to the combined thickness of the first conductive layer 302, the second conductive layer 502, and the resistive layer 702, which, in embodiments, may be approximately 6000 Angstroms.

Figure 10A:
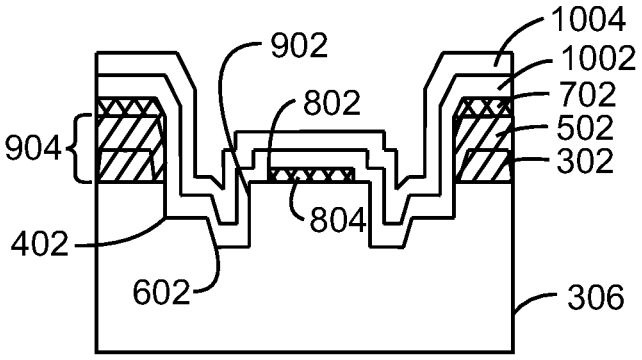
FIGS. 10A and 10B are a cross-section side view and a cross-section front view of a fully-layered heating element of a fluid ejection device.
Figure 10B:
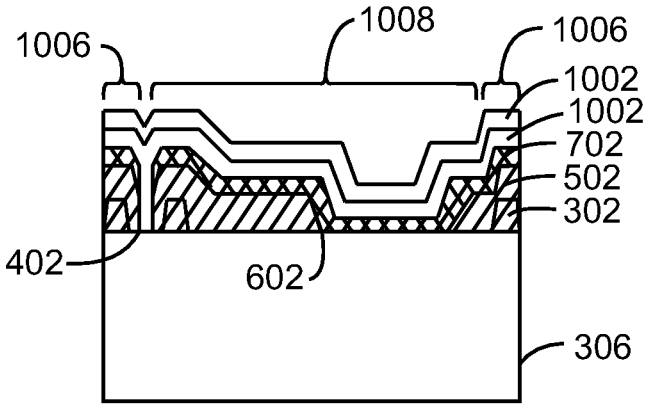

FIGS. 10A and 10B are a cross-section side view and a cross-section front view of a heating element of a fluid ejection device. FIG. 10A is a cross-section side view of the heating element 1000. As seen in FIG. 10A, a passivation layer 1002 and a cavitation barrier layer 1004 have been deposited over the heating element 900 of FIG. 9B. It is to be noted that the passivation layer 1002 and the cavitation barrier layer 1004 share topographic profiles similar to the structures they overlie. The deep etch 902 and the shallow slots 802 help ensure that the topography of the passivation layer 1002 and the cavitation barrier layer 1004 near the resistor pad 804 is minimal, as the thickness of the resistor pad is relatively thin, as thin as approximately 1000 Angstroms in embodiments.

FIG. 10B is a cross-section front view of the fully-layered heating element 1000. As seen in FIG. 10B, the combination of the first conductive layer 302 and the second conductive layer 502 define a conductive layer that includes an outer perimeter 1006 and an inner region 1008. The outer perimeter can be composed of both the first conductive layer 302 and the second conductive layer 502, and may be located just outside the boundaries of the first window 402. The inner region 1008 may be generally thinner than the outer perimeter 1006, and can be located within the first window 402 near the second window 602. The layout of these conductive layers help to keep the overall topography of the heating element low, particularly in the region on and around the resistor, where the protective films are subjected to high temperature chemical and physical attack.

The raised bridge region around the resistor pad 804, by design, contains significantly less topography than the surrounding area. Barrier layers can then be formed over the fully-layered heating element 1000 define a boundary of a fluid chamber which is aligned to create a border that sits within the borders of the raised bridge region. The resulting firing resistor and chamber, where materials are exposed to high temperatures, chemical and physical attack, has increased robustness to failure.

Figure 11:
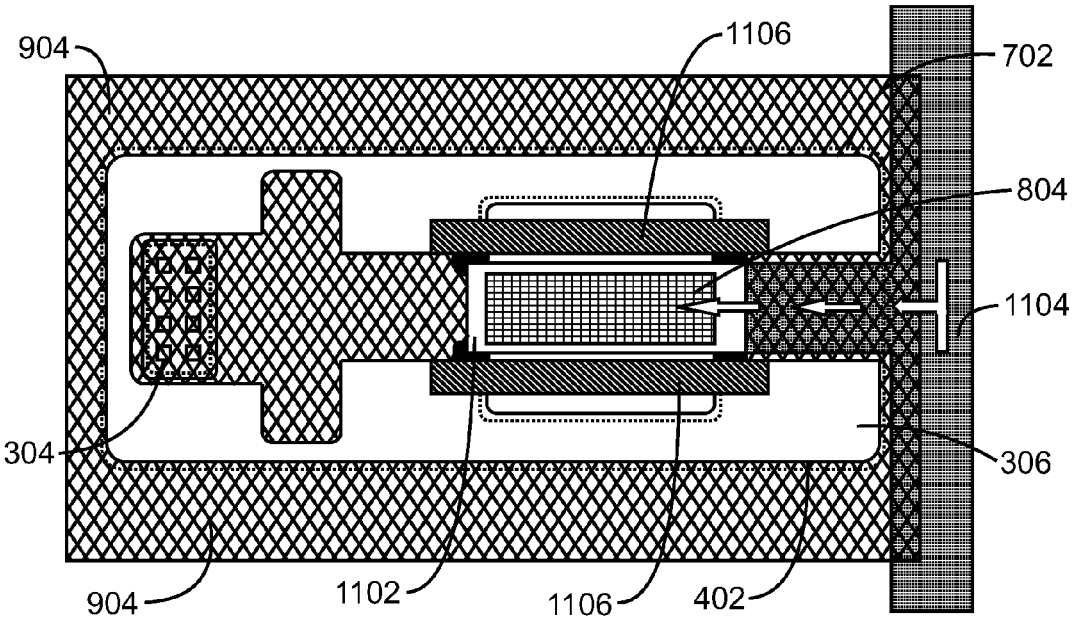
FIG. 11 is a top view of a heating element placed in a fluid ejection device.

FIG. 11 is a top view of a heating element placed in a fluid ejection device. As seen in FIG. 11, barrier layers can be formed around the resistor pad 804 to define the boundaries of a firing chamber 1102. Ink 1104 can be injected into the firing chamber 1102, where it can be heated by the resistor pad 804. The barrier layers constrain the ink 1104 within the boundaries of the firing chamber 1102 such that the ink 1104 remains in direct contact with the resistor pad 804. The topography of the region near the resistor pad 804 is significantly reduced relative to other regions of the heating element 1100, thus improving the longevity of the resistor pad 804. In embodiments, high topography regions 1106 can exist outside of the firing chamber 1102, where the high topography poses minimal risk to the resistor pad 804.

Figure 12:
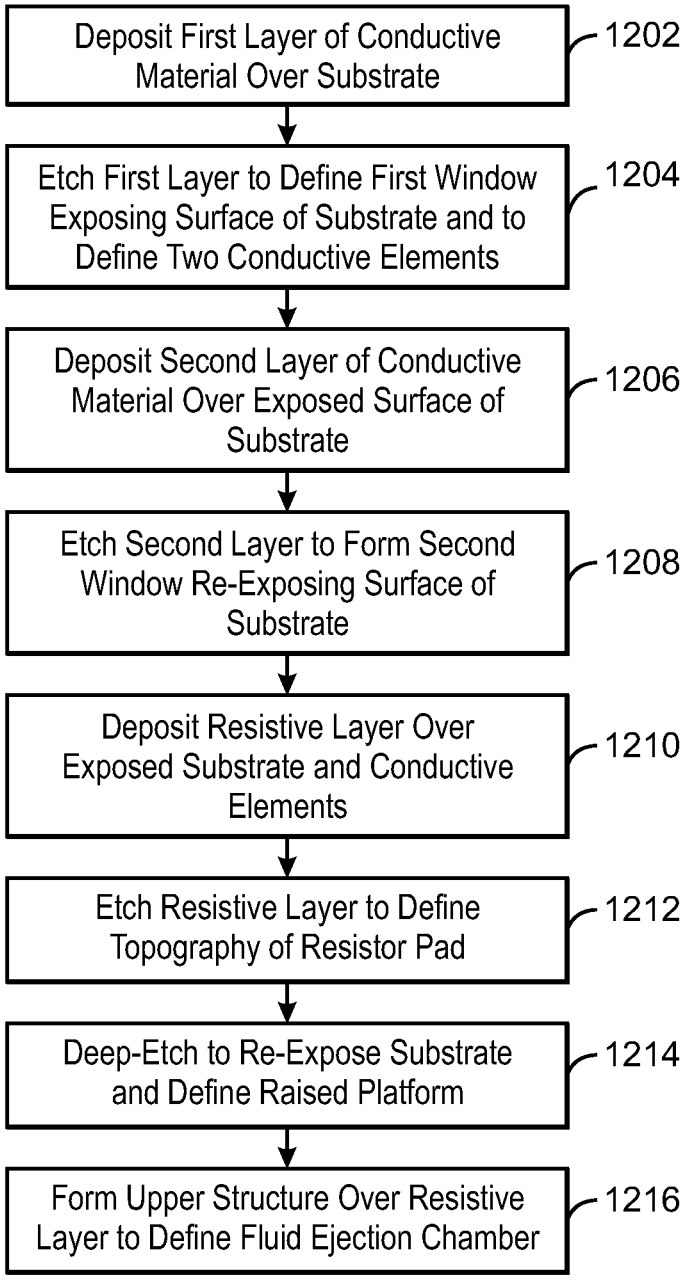
FIG. 12 is a process flow diagram of a method for forming a heating element of a fluid ejection device.

FIG. 12 is a process flow diagram of a method for forming a heating element of a fluid ejection device. The method 1200 can be used to form the heating element embodiments described in FIGS. 3-11. At block 1202, a first layer of a conductive material is deposited over a substrate. At block 1204, the first layer of the conductive material is etched to define a first window exposing a top surface of the substrate and to define conductive elements spaced apart from one another on opposite sides of the first window. The first window may have a length that is substantially longer than the length of a resistor pad of the heating element. At block 1206, a second layer of the conductive material is deposited over the exposed top surface of the substrate, within the first window, and over the conductive elements. At block 1208, the second layer of the conductive material is etched to form a second window re-exposing the top surface of the substrate. The second window may have a length that is substantially equal to the length of the resistor pad of the heating element. At block 1210, a layer of resistive material is deposited over the exposed substrate within the second window and over the conductive elements. The layer of resistive material extending within the second window may define the resistor pad. At block 1212, the layer of resistive material is etched such that the width of the resistor pad is substantially smaller than the width of a raised bridge that the resistor pad can lie on top of. At block 1214, the first window is deep-etched so as to re-expose the substrate and to define the raised bridge within the second window. At block 1216, an upper structure is formed over the layer of resistive material to define an orifice through which fluid is capable of being ejected.

While the present techniques may be susceptible to various modifications and alternative forms, the exemplary examples discussed above have been shown only by way of example. It is to be understood that the technique is not intended to be limited to the particular examples disclosed herein. Indeed, the present techniques include all alternatives, modifications, and equivalents falling within the true spirit and scope of the appended claims.

What is claimed is:

1. A heating element, comprising:

a substrate;

a conductive layer disposed on the substrate, the conductive layer comprising an outer perimeter and an inner region thinner than the outer perimeter, the outer perimeter comprising conductive elements spaced apart from one another;

a resistive layer, comprising:

an outer resistive portion overlying the conductive elements; and a central resistive portion lying on top of a raised bridge of the substrate, wherein the width of the raised bridge is substantially greater than the width of the central resistive portion, and wherein the height of the raised bridge is substantially equal to the height of a bottom of the central resistive portion for the entire width of the raised bridge; and at least one upper layer defining a boundary of a fluid chamber, the boundary aligned vertically above the central resistive portion.

2. The heating element of claim 1, further comprising an etched window contained within the outer perimeter, wherein the central resistive portion is at least partially contained inside the etched window.

3. The heating element of claim 1, wherein a thickness of the resistive layer is substantially smaller than the height of the raised bridge.

4. The heating element of claim 1, wherein the conductive elements are beveled inward.

5. The heating element of claim 2, wherein the substrate comprises:

a first substrate portion underlying the conductive elements, the first substrate portion comprising an insulation layer and a neutralizing layer on top of the insulation layer; and a second substrate portion underlying the resistive layer within the etched window, the second substrate portion comprising the insulation layer while omitting the neutralizing layer;

wherein the first substrate portion is positioned externally of the boundary of the fluid chamber.

6. The heating element of claim 1, wherein the at least one upper layer comprises a barrier layer.

7. The heating element of claim 6, further comprising at least one of a passivation layer or a cavitation barrier layer overlying the resistive layer and extending underneath the barrier layer.

8. A method of forming a heating element of a fluid ejection device, comprising:

forming a conductive layer comprising an outer perimeter and an inner region, the outer perimeter comprising conductive elements on a substrate, the conductive elements spaced apart from one another;

etching a first window interposed between the conductive elements to expose the substrate;

forming a resistive layer over the conductive elements, and over the exposed substrate to define a central resistive portion within the first window;

deep-etching the heating element to form a raised bridge of the substrate, wherein the central resistive portion lies on top of the raised bridge, a width of the raised bridge being substantially larger than a width of the central resistive portion, and wherein the raised bridge is flat for the entire width of the raised bridge when finally formed; and forming a fluid chamber, comprising an orifice to eject fluid, over the resistive layer.

9. The method of claim 8, further comprising etching a second window within the first window, wherein the central resistive portion is at least partially contained in the second window.

10. The method of claim 8, wherein a thickness of the resistive layer is substantially smaller than a height of the raised bridge.

11. The method of claim 8, wherein the conductive elements are beveled inwards.

12. The method of claim 8, wherein the substrate comprises:

a first substrate portion underlying the conductive elements, the first portion comprising an insulation layer and a neutralizing layer on top of the insulation layer; and a second substrate portion underlying the resistive layer within the first window, the second portion comprising the insulation layer while omitting the neutralizing layer;

wherein the first substrate portion is positioned externally of a boundary of the fluid chamber.

13. The method of claim 8, wherein forming the fluid chamber further comprises forming a barrier layer to at least partially define a boundary of the fluid chamber.

14. The method of claim 13, further comprising forming at least one of a passivation layer or a cavitation barrier layer overlying the resistive layer and extending underneath the barrier layer.

15. A heating element prepared according to the process comprising:

depositing a first layer of a conductive material over a substrate;

etching the first layer of the conductive material to define a first window exposing a top surface of the substrate and to define conductive elements spaced apart from one another on opposite sides of the first window, the first window having a length substantially longer than a length of a resistor pad of the heating element;

depositing a second layer of the conductive material over the exposed top surface of the substrate, within the first window, and over the conductive elements;

etching the second layer of conductive material to form a second window re-exposing the top surface of the substrate, the second window having a length substantially equal to the length of the resistor pad of the heating element;

depositing a resistive layer over the exposed substrate within the second window and over the conductive elements, wherein the resistive layer extending within the second window defines the resistor pad;

etching the resistive layer such that the width of the resistor pad is substantially smaller than the width of a raised bridge that the resistor pad lies on top of, wherein the depth of the etch is substantially equal to the thickness of the resistive layer, and wherein the height of the raised bridge substantially equals the depth of the etch for the entire width of the raised bridge when finally formed;

deep-etching within the first window so as to re-expose the substrate and to define the raised bridge within the second window; and forming an upper structure over the resistive layer to define an orifice through which fluid is capable of being ejected.

* * * * *